United States Patent [19]

Gehrie et al.

[11] 3,942,344

[45] Mar. 9, 1976

[54] COMBINATION LOCK

[75] Inventors: Charles S. Gehrie, Montclair; Irving Feinberg, Saddle Brook, both of N.J.

[73] Assignee: Presto Lock Company, Division of Walter Kidde & Company, Inc., Elmwood Park, N.J.

[22] Filed: Nov. 5, 1974

[21] Appl. No.: 521,043

[52] U.S. Cl. ..... 70/70; 70/312

[51] Int. Cl.[2] ..... E05B 65/52; E05B 37/02

[58] Field of Search ..... 70/64, 67, 70, 312, 316, 70/318

[56] References Cited

UNITED STATES PATENTS 3,439,515 4/1969 Gehrie ..... 70/288

3,543,545 12/1970 Budzyn ..... 70/71

*Primary Examiner*—Albert G. Craig, Jr.

*Attorney, Agent, or Firm*—Shapiro and Shapiro

[57] ABSTRACT

A combination lock, including a plurality of dials and associated sleeve means for each dial, has a plug member which is longitudinally movable to first and second positions and which is cooperable with the sleeve means for being locked in the first position when the dials are off combination. A manually operable latch member formed to engage a hasp is longitudinally movable from a latching position to an unlatching position only when the plug member is not locked in the first position. Longitudinally movable pullers are provided for moving the latch member from latching to unlatching position and from unlatching to latching position, respectively.

19 Claims, 12 Drawing Figures

COMBINATION LOCK

This invention relates to combination locks of the multiple-dial type, and is more particularly directed to improvements in combination locks of the type disclosed in Gehrie U.S. Pat. No. 3,439,515, granted Apr. 22, 1969.

BACKGROUND OF THE INVENTION

In the combination lock disclosed in Gehrie U.S. Pat. No. 3,439,515, a manually operable latch member cooperable with a hasp has longitudinally spaced bars defining slots which receive respective rotatably mounted dials having indicia or numbers thereon, each dial having associated therewith a sleeve having a flange and a flat portion. When the device is in a locked condition or "off combination", a flange of a sleeve cooperates with one of the bars of the latch member to block movement of the latch member from latching position. When the device is in an open condition or "on combination", the sleeves are oriented with the flange portions out of blocking position in relation to the bars of the latch member so that the latch member can be moved between latching and unlatching positions. When the latch member is in unlatching position, the bars cooperate with the flat portions of the sleeves to prevent their rotation and the rotation of the associated dials, thereby maintaining the lock on combination.

Combination locks made in accordance with the Gehrie patent have been satisfactory for use in connection with luggage cases and the like. However, because the amount of travel of the latch member between the latching and unlatching position is comparatively small (i.e., approximately equal to the thickness of the flat portion of a sleeve), the latch member engages a cooperable hasp to this limited extent. It is desirable that the amount of travel of the latch member be increased for thereby increasing the extent of engagement of the latch member with the hasp.

SUMMARY OF THE INVENTION

Accordingly, a principal object of the invention is to provide an improved combination lock of the type disclosed in the aforesaid Gehrie patent and, more specifically, to provide a combination lock in which the amount of travel of the latch member is increased.

Another object of the invention is to provide a combination lock of the above-described type which is provided with longitudinally movable pullers for moving the latch member from latching to unlatching position and from unlatching to latching position, respectively.

Another object of the invention is to provide a combination lock of the above-described type which may be aesthetically incorporated into the handle stud of a luggage case or the like.

A combination lock constructed in accordance with the invention employs a plurality of rotatable dials each having sleeve means associated therewith, a plug member supported for longitudinal movement between first and second positions and cooperable with the sleeve means for being releasably locked in said first position when the lock is off combination, and a latch member which is manually movable longitudinally to a latching position and an unlatching position. The latch member and the plug member have cooperable means for maintaining the latch member in latching position when the plug member is locked in the first position. Longitudinally movable pullers are provided for moving the latch member from latching to unlatching position and from unlatching to latching position, respectively, when the plug member is not locked in the first position.

In the preferred embodiment, each sleeve means has a flange and a flat portion and the plug member has longitudinally spaced bars defining slots which receive respective dials, the flanges on the sleeve means being cooperable with the bars for locking the plug member in the first position when the dials are off combination. The latch member, which is manually movable longitudinally to the latching and unlatching positions by means of the first and second pullers, has a hook portion for engaging a cooperable hasp.

When the lock is off combination, with the plug member locked in this first position, one end surface of the plug member is cooperable with an abutment surface on a vertical wall at one end of the latch member for preventing movement of the latch member from latching position to unlatching position. However, when the dials are set on combination, the flanges are moved out of blocking relation with the bars on the plug member so that the latch member can be moved toward unlatching position by means of the first puller. During the first part of this movement, the abutment surface on the latch member cooperates with the end portion of the plug member to move the plug member from the first to the second position. Then, cooperable cam surfaces provided by the frame of the combination lock and by the latch member cause the abutment surface on the latch member to then be shifted out of abutting relationship with the end portion of the plug member so that the latch member can then bypass the plug member and be moved fully into unlatching position for disengaging the hasp. When the latch member is in unlatching position, the bars of the plug member cooperate with the flat portions of the sleeve means to prevent rotation of the sleeve means and their associated dials from the opening combination.

When it is desired to re-engage the hasp, the latch member is moved in the opposite direction into the latching position by means of the second puller. A surface on an upstanding wall at the other end of the latch member during this motion acts against the corresponding end of the plug member to return the plug member to the above-described first position, in which position the plug member may then be locked by rotating the dials from on to off combination.

These, and other advantages and improved results furnished by the combination lock of the invention will be apparent from the following detailed description of an illustrated and preferred embodiment of the invention.

DESCRIPTION OF THE PREFERRED EMBODIMENT

Figure 1:
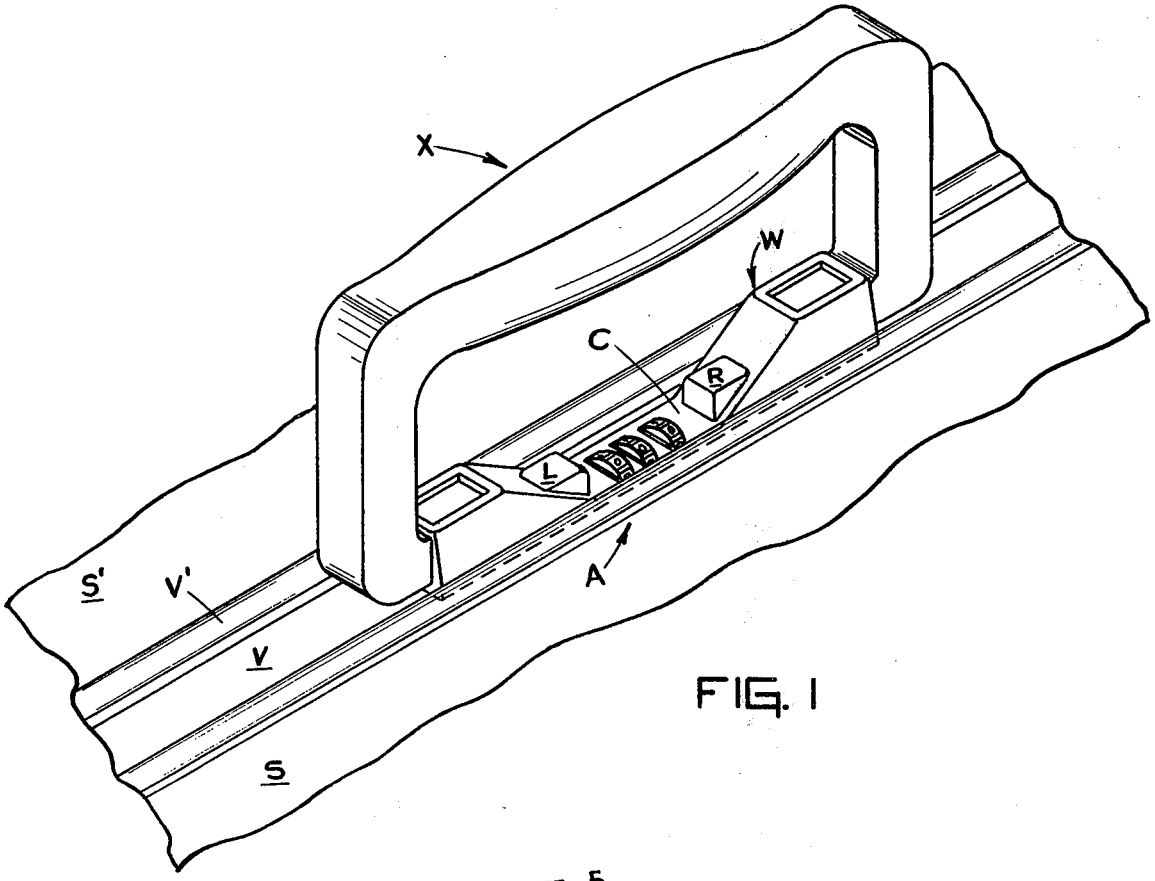
FIG. 1 is a perspective view of a combination lock in accordance with the invention incorporated into the handle stud of a luggage case.

Referring to the drawings, a combination lock A made in accordance with the invention is cooperable with a hasp B. Generally, the combination lock comprises a face plate C, a frame D, a shaft E, dials F and associated sleeve means G, a plug member H, a latch member J, a cover plate K, left-hand and right-hand pullers L and R, and resilient means M and N acting upon and cooperable with the cover plate and the ends of the latch member.

Figure 3:
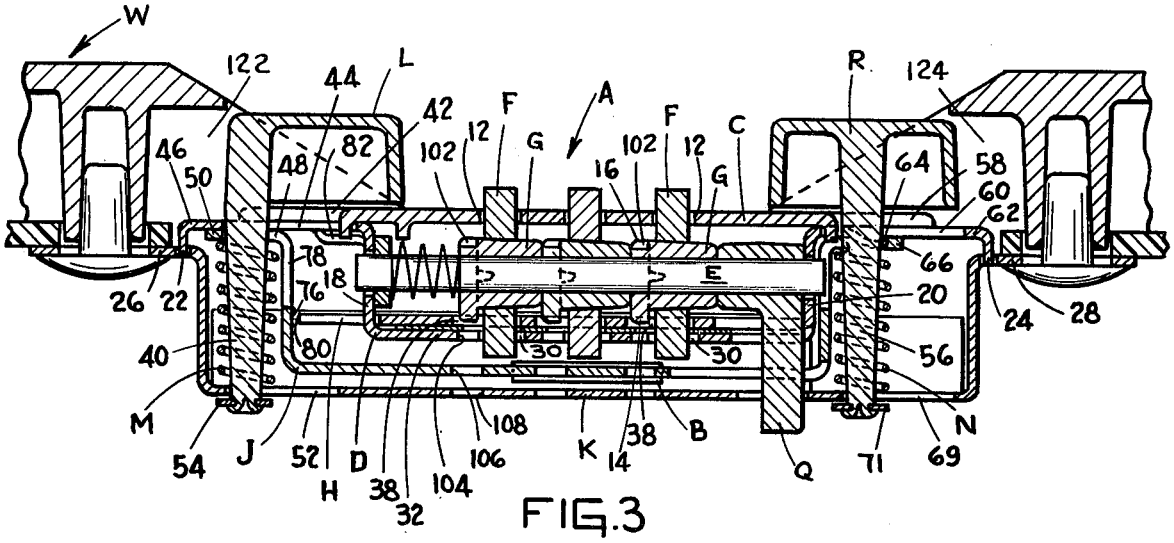
FIG. 3 is a longitudinal cross-sectional view of the lock taken approximately in the plane of line 3—3 of FIG. 2, this view showing the latch member locked in latching position.
Figure 5:
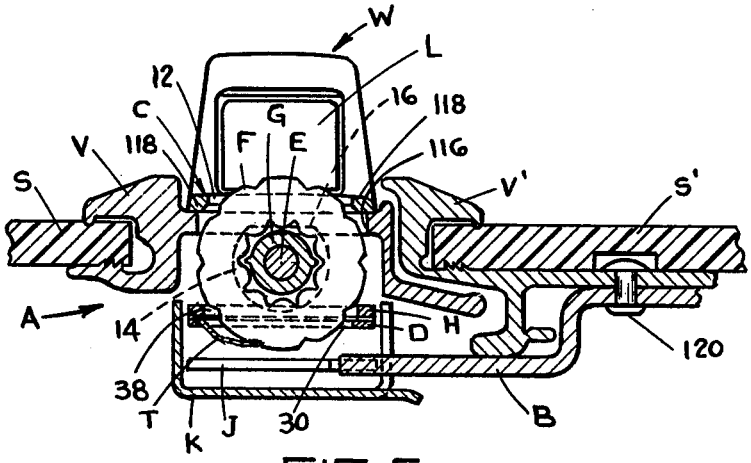
FIG. 5 is a transverse cross-sectional view taken approximately in the plane of line 5—5 of FIG. 2.
Figure 7:
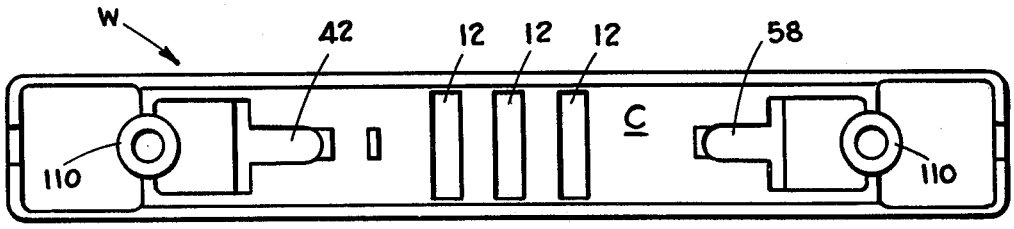
FIG. 7 is a bottom view of the handle stud.
Figure 8:
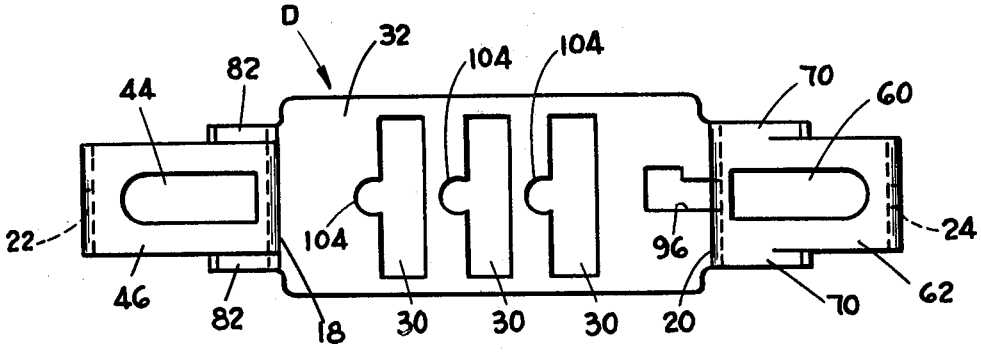
FIG. 8 is a plan view of a frame employed in the lock.
Figure 12:
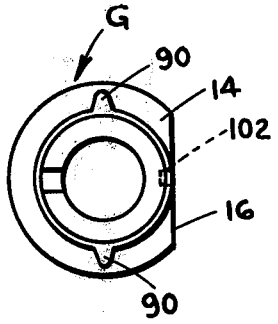
FIG. 12 is a side elevational view of a sleeve associated with the dial of FIG. 11.

Referring to FIG. 3, face plate C has a plurality of longitudinally spaced slots 12 (FIG. 7). Longitudinally extending shaft E is supported just below the face plate by the frame D so that the dials F, which are rotatably supported on the shaft with their associated sleeve means G, extend partially through the slots 12. As shown in FIGS. 5 and 12, each sleeve means G is provided with a flange 14 and a flat portion 16. The opposite ends of the shaft E are mounted in respective openings in the vertical end wall portions 18 and 20 of the frame D. Lugs 22 and 24 provided at opposite ends of the frame are received by respective openings in horizontal end portions 26 and 28 of bottom cover plate K, which is held in position against the face plate by rivets 114, as described more fully hereinafter. As shown in FIG. 8, frame D is further provided with longitudinally spaced slots 30 which receive respective dials F.

Figure 4:
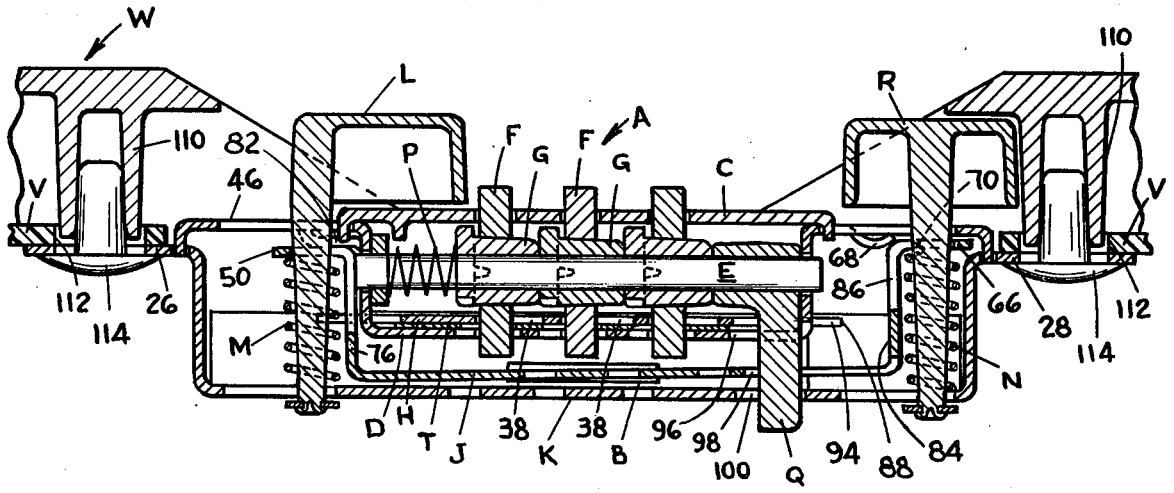
FIG. 4 is a view similar to FIG. 3, but with the latch member shown in unlatching position.
Figure 9:
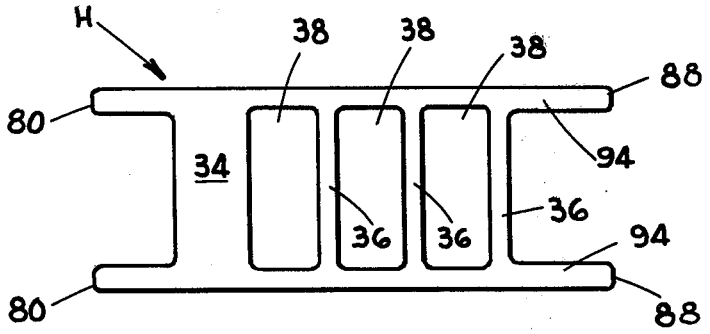
FIG. 9 is a plan view of a plug member employed in the lock.

Supported by the horizontal central portion 32 (FIG. 8) of frame D for longitudinal movement between first and second positions shown in FIGS. 3 and 4, respectively, is the locking member or plug member H, shown most clearly in FIG. 9. Longitudinally spaced bars 34 and 36 define slots 38 which receive respective dials F. These slots are aligned with but are wider than the slots 12 in face plate C and slots 30 in frame D so that they can also receive the flanges 14 of the associated sleeve means, as shown in FIG. 3.

Referring to FIG. 3, when the dials are off combination, one or more of the flanges 14 of the sleeve means are received by slots 38 in the plug member so that the flange or flanges are cooperable with bars 34 and 36 of the plug member for maintaining the plug member in the position shown in FIG. 3. On the other hand, when the dials are set to the predetermined opening combination, as shown in FIG. 4, the flanges are moved out of blocking relationship with the bars so that the plug member can be moved between the positions shown in FIGS. 3 and 4.

Positioned beneath frame D and plug member H is the latch member J which is supported for longitudinal movement between the latching and unlatching positions shown in FIGS. 3 and 4, respectively. Supported for longitudinal sliding movement on the face plate C are longitudinally spaced left-hand and right-hand pullers or pushbuttons L and R which engage opposite ends of the latch member for manually moving the latch member from latching to unlatching position and from unlatching to latching position, respectively. Referring to FIG. 3, the left-hand puller L has a projecting stud 40 which extends successively through a longitudinal slot 42 in the face plate (FIG. 7), an aligned slot 44 in horizontal left end portion 46 of frame D (FIG. 8), an opening 48 in the horizontal left end portion 50 of latch member J (FIG. 10), the opening comprising part of a slot formed in the horizontal end portion 50 and in the vertical wall portion 78 of the frame, and through a longitudinal slot 52 in cover plate K. A washer 54 mounted at the end of the stud is cooperable with the cover plate for holding the puller L in place against the face plate. Resilient biasing means in the form of a coil spring M carried by the stud acts against the cover plate to urge end portion 50 of the latch member against the underside of the face plate. In similar fashion, puller R has a projecting stud 56 which extends through a longitudinal slot 58 in the face plate, an aligned slot 60 in the horizontal right end portion 62 of the frame, an opening 64 in the horizontal right end portion 66 of the latch member (formed in the same manner as opening 48), and through a longitudinal slot 69 in the cover plate, the end of this stud having a washer 71 fixed thereto for holding the puller in position against the face plate. Resilient biasing means in the form of a coil spring N carried by stud 56 acts against the cover plate for urging end portion 66 of the latch member upwardly against the face plate.

Figure 6:
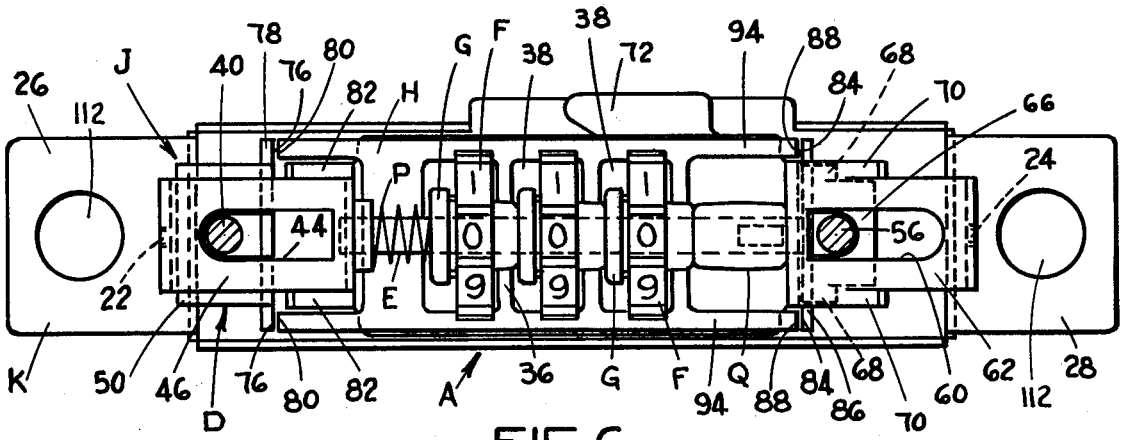
FIG. 6 is a top plan view of the lock of FIG. 1, but with the handle stud and face plate omitted and with the pullers in cross section.

As shown in FIGS. 4 and 6, the right end portion 66 of the latch member is provided with a pair of laterally spaced camming surfaces 68 (FIG. 10) which are urged into engagement with a pair of cooperable camming surfaces 70 on the frame (FIG. 8) by spring N to provide detent means for resiliently maintaining the latch member in the respective latching and unlatching positions.

Figure 10:
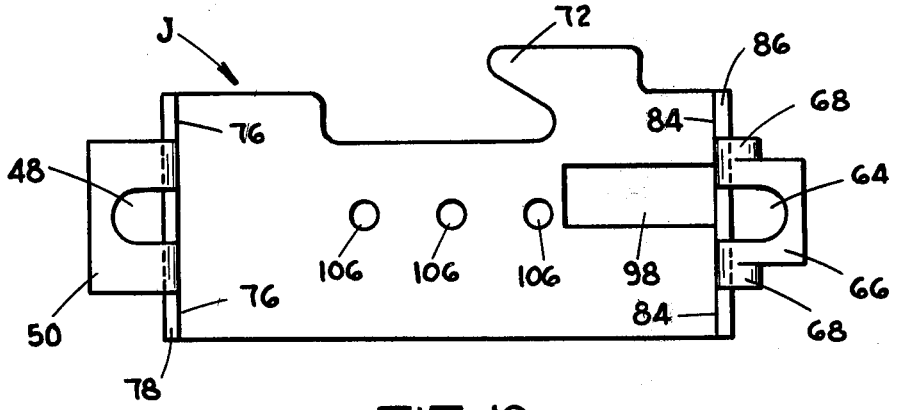
FIG. 10 is a plan view of a latch member employed in the lock.

As shown in FIG. 10, the latch member has a hook portion 72 for engaging a cooperable hook portion 74 of a hasp B (see FIG. 2) when the latch member is releasably locked in the latching position (shown in FIG. 3) by plug member H, as described hereinafter.

When plug member H is locked in the position shown in FIG. 3 by one or more flanges 14 of sleeve means G (i.e., when the dials F are off combination), latch member J cannot be moved rightwardly into unlatching position by pushing on puller or button R. The latch member can be moved rightwardly, as viewed in FIG. 3, only a short distance before abutment surfaces 76 provided by the left vertical wall 78 of the latch member are brought into contact with stop means provided by the left end surfaces 80 of the plug member, as shown in FIGS. 3 and 6. This prevents further movement of the latch member toward unlatching position. During this limited movement, camming surfaces 70 and 68 on the frame and the latch member, respectively, cooperate to cause the right end portion 66 of latch member J to be moved downwardly relative to face plate C against the force of coil spring N. Thus, when the manual pressure applied to puller R is thereafter released, the coil spring and camming surfaces cooperate to return the latch member to the latching position shown in FIGS. 2, 3 and 6.

When it is desired to disengage the combination lock from the hasp, the dials are rotated to the opening combination so that the flanges 14 of the sleeve means G are removed from the slots 38 and clear bars 34, 36 of the plug member. Longitudinal rightward movement of the latch member toward unlatching position by means of puller R brings abutment surfaces 76 of the latch member into contact with end surfaces 80 of the plug member, as described previously. However, referring to FIG. 3, because the flanges 14 on the sleeve means are moved out of blocking relationship with the bars on the plug member, further movement of the latch member toward unlatching position is permitted, which causes the upstanding abutment surfaces 76 to carry or shift the plug member longitudinally with the latch member until the bars of the plug member nearly contact dials F, as shown in FIG. 4. Just before the plug member is carried fully into this position by the latch member, the left end portion 50 of the latch member is brought into engagement with a pair of transversely spaced camming surfaces 82 provided adjacent the left end portion 46 of the frame (FIG. 6) for causing the left end of the latch member to be moved downwardly from face plate C against the urging of biasing spring M. Thus, the abutment surfaces 76 on the latch member are moved transversely out of abutting relation with end surfaces 80 of the plug member. This enables the abutment surfaces of the latch member to bypass the end surfaces of the plug member so that the latch member can be moved fully into the unlatching position shown in FIG. 4. Because the plug member and the latch member each have a dead bolt action, camming surfaces 68 and 70, provided by the latch member and the frame, respectively, in cooperation with springs M and N on the pullers resiliently maintain the latch member in unlatching position. Thus, when the latch member is in unlatching position, the plug member is in the position shown in FIG. 4 and bars 34 and 36 on the plug member cooperate with flat portions 16 on the sleeve means for preventing rotation of the sleeve means and their associated dials from the predetermined opening combination.

Due to the ability of the latch member to bypass the plug member for a portion of its movement, the total travel of the latch member between latching and unlatching positions may be about 0.25 inch, for example, which is considerably greater than the total longitudinal movement of the plug member, which may be about 0.10 inch, for example. This increased travel provides for more positive engagement of the hook portion 72 of the latch member with hook portion 74 of the hasp.

To return the latch member to latching position for engaging the hasp, puller L is manually moved leftwardly as viewed in FIG. 4. Referring to FIG. 6, during this motion surfaces 84 (FIG. 10) on the vertical right end wall 86 of the latch member are brought into contact with end surfaces 88 (FIG. 9) of the plug member for returning the plug member to the position shown in FIG. 3. The dials and their associated sleeves may then be rotated from on to off combination to lock the plug member in that position, thereby locking the latch member in latching position.

Figure 11:
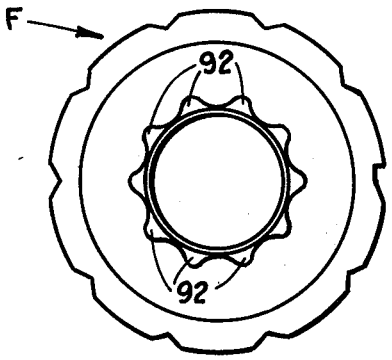
FIG. 11 is a side elevational view of a dial employed in the lock.

In the preferred form of the invention, the sleeve means G are separable from their associated dials F, the sleeves and dials having cooperable means for releasably keying them together to permit the selection of a combination of one's own choice. For example, the sleeve means G may have a pair of teeth 90 (FIG. 12) which are receivable by notches 92 in dials F (FIG. 11). As shown in FIG. 4, a spring P is provided around the end of the shaft E opposite the end which carries a shift lever Q, the spring serving to normally urge the sleeves into keyed relationship with their respective dials. The lever Q is rotatably mounted on the shaft E and extends between the right end portions 94 of the plug member (see FIG. 9) and through aligned longitudinal slots 96, 98 and 100 in the frame (FIG. 8), the latch member (FIG. 10), and the cover plate, respectively. The lever may be rotated and then pushed against the force of spring P to disengage the sleeves from their assoicated dials for enabling the dials to be rotated to different circumferential positions relative to the sleeves for thereby establishing a combination of one's choice.

In the illustrated form of the invention there are three separate sleeves and three associated dials. The three dials each have ten indicia or numbers thereon so that there are 1,000 different combinations available. It will, of course, be understood that any desired number of dials may be used to furnish the desired number of combinations. A spring member T (see FIGS. 4 and 5) is cooperably related to the dials so that the dials are releasably maintained in selected circumferential positions.

Also, in the preferred and illustrated form of the invention the combination locking means has visual indicator means of the type disclosed in Gehrie U.S. Pat. No. 3,416,338 granted Dec. 17, 1968. As shown in FIG. 3, the flat portion 16 of each sleeve G has indicator means, such as a slot 102 (see FIG. 12), adapted to be located by being viewed or felt through the slots 38 in the plug member H and aligned openings 104, 106 and 108 in frame D, latch member J, and cover plate K, respectively. This enables the sleeve means to be rotated to the positions shown in FIG. 4 to establish the opening combination of the latching device in the event that the opening combination is lost while the bottom side of the latching device is still accessible.

The combination lock A and the hasp B may be secured to the parts which they are intended to lock together in any suitable manner. For example, as illustrated in FIGS. 1 – 5, the combination lock and hasp are applied to a luggage case wherein the face plate C comprises part of a handle stud W to which a handle X is suitably connected. Referring to FIG. 4, where the handle stud is a die-cast part, as preferred, it is provided with longitudinally spaced, integral, hollow connecting studs 110 which are received by aligned openings 112 provided in a male valance member V which is mounted on a luggage case shell S, as shown in FIG. 5. End portions 26 and 28 of cover plate K are provided with openings through which tapered rivets 114 are extended into the bores of the connecting studs 110 to connect the handle stud and the cover plate to the valence member V. As shown in FIG. 5, the major part of the height of the latching device is extended through an opening 116 in valance member V with the longitudinal edges 118 of the handle stud resting on the valance member adjacent the opening.

Figure 2:
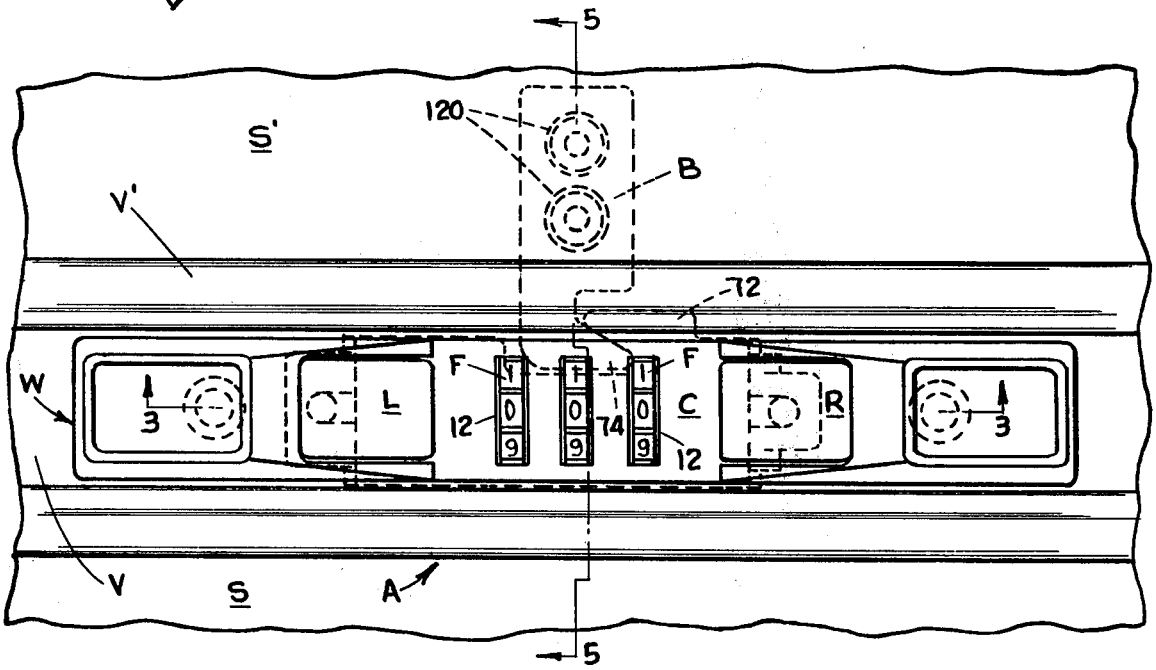
FIG. 2 is a top plan view of the lock of FIG. 1, but with the luggage case handle omitted, this view showing the relationship of the latch member to a hasp.

Referring to FIG. 5, the hasp B is secured to a female valance member V′ carried by the opposing case section or shell S′ by any suitable means, such as headed rivets 120. As shown in FIG. 2, the engageable faces of the hook portion 72 of the latch member and hook portion 74 of the hasp are matingly angled to facilitate the drawing together of the luggage case sections S and S′ when the combination lock A and the hasp B are used for luggage application as herein illustrated. Moreover, when the latching device of the invention is incorporated into the handle stud of a luggage case or the like, as illustrated in FIGS. 1 – 5, the left and right ends of the pullers L and R can be conveniently actuated by thumb pressure from the left and right hands, respectively, of an operator to provide a solid, positive latching and unlatching action. To ensure proper manipulation of the pullers, the leftmost face of the left-hand puller L is received by a recess 122 in the handle stud and the rightmost face of the right-hand puller R is received by a recess 124 in the handle stud, as shown in FIG. 3.

It is believed that the advantages and improved results afforded by the combination lock of the present invention will be apparent from the foregoing detailed description of a preferred embodiment thereof. Various changes and modifications may be made to the preferred embodiment of the invention as hereinbefore described without departing from the spirit and scope of the invention as sought to be defined in the following claims.

We claim:

1. A combination lock comprising:

a plurality of dials supported for rotation about a longitudinal axis, each dial having sleeve means associated therewith;

a plug member supported for movement longitudinally between first and second positions, the sleeve means having means cooperable with the plug member for releasably locking the plug member in said first position when the dials are off combination; and a manually operable latch member longitudinally movable with respect to the plug member to a latching position and an unlatching position, the latch member and the plug member having engageable means for preventing movement of the latch member to unlatching position when the plug member is locked in the first position.

2. A combination lock as set forth in claim 1, wherein the plug member has longitudinally spaced bars defining slots which receive respective dials, and wherein each of the sleeve means has a flange and a flat portion, the flanges being cooperable with the bars of the plug member for releasably locking the plug member in said first position when the dials are off combination and for permitting the plug member to be moved between said first and second positions when the dials are on combination.

3. A combination lock as set forth in claim 2, wherein the plug member has stop means cooperable with an abutment surface on the latch member for preventing movement of the latch member to said unlatching position when the plug member is locked in said first position, and wherein the lock further comprises bypass means for enabling the abutment surface on the latch member to bypass said stop means when the plug member is not locked in said first position so that the latch member can be moved into unlatching position.

4. A combination lock as set forth in claim 3, wherein the bypass means comprises a camming surface cooperable with means provided by the latch member for moving the abutment surface of the latch member out of abutting relationship with said stop means.

5. A combination lock as set forth in claim 3, wherein the abutment surface and the stop means cooperate to shift the plug member from said first position to said second position as the latch member is moved from latching to unlatching position, and wherein the plug member and the latch member have cooperable means for returning the plug member to said first position when the latch member is moved from unlatching to latching position.

6. A combination lock as set forth in claim 1, further comprising means for resiliently maintaining the latch member in the latching and unlatching positions.

7. A combination lock as set forth in claim 1, wherein the plug member and the latch member each have a dead bolt action.

8. A combination lock as set forth in claim 1, wherein the latch member has longitudinally spaced first and second pullers associated therewith for moving the latch member from latching to unlatching position and from unlatching to latching position, respectively.

9. A combination lock as set forth in claim 1, wherein the latch member has a hook portion for engaging a cooperable hasp when the latch member is in said latching position.

10. A combination lock as set forth in claim 2, wherein the sleeve means are separable from their associated dials, and wherein the lock further comprises means for changing the circumferential positions of the dials relative to their associated sleeve means.

11. A combination lock comprising:

a face plate having longitudinally spaced slots;

a plug member positioned beneath the face plate and supported for movement longitudinally between first and second positions, the plug member having longitudinally spaced bars defining slots in alignment with but of greater width than that of the face plate slots;

a longitudinally extending shaft;

a plurality of dials rotatably mounted on the shaft and positioned in said slots, sleeve means associated with each dial and having a flange and a flat portion, the flanges being cooperable with the bars of the plug member for releasably locking the plug member in said first position when the dials are off combination and for permitting the plug member to be moved between said first and second positions when the dials are on combination; and a latch member supported for movement longitudinally with respect to the plug member to a latching position and an unlatching position, the latch member and the plug member having engageable means for preventing movement of the latch member to unlatching position when the plug member is locked in said first position.

12. A combination lock as set forth in claim 11, wherein an end surface on the plug member is cooperable with an abutment surface on a vertical wall at the corresponding end of the latch member for preventing movement of the latch member to unlatching position when the plug member is locked in said first position, and wherein the lock further comprises a camming surface cooperable with means provided at said corresponding end of the latch member for moving the abutment surface transversely out of abutting relationship with said end surface on the plug member as the latch member is moved from latching position to unlatching position when the plug member is not locked in said first position, detent means cooperable with means provided at the other end of the latch member for resiliently maintaining the latch member in the latching and unlatching positions, and biasing means for urging said one end and said other end of the latch member into engagement with said camming means and said detent means.

13. A combination lock as set forth in claim 12, wherein the abutment surface and the end surface cooperate to shift the plug member from said first position to said second position as the latch member is moved from latching to unlatching position, and wherein another surface on another vertical wall at the other end of the latch member is cooperable with the other end of the plug member for returning the plug member to said first position as the latch member is moved from unlatching to latching position.

14. A combination lock as set forth in claim 12, further comprising manually operable first and second longitudinally movable pullers slidably supported by the face plate and having means projecting through respective openings in the face plate for engaging said one end and said other end, respectively, of the latch member for thereby moving the latch member from latching to unlatching position and from unlatching to latching position, respectively.

15. A combination lock as set forth in claim 14, wherein the means projecting through openings in the face plate comprises first and second studs which are received by openings in said one end and said other end, respectively, of the latch member, and wherein said biasing means comprises first and second coil springs carried by said first and second studs, respectively.

16. A combination lock as set forth in claim 11, further comprising detent means for resiliently maintaining the latch member in said latching and unlatching positions.

17. A combination lock as set forth in claim 11, wherein said plug member and said latch member each have a dead bolt action.

18. A combination lock as set forth in claim 11, wherein the face plate comprises part of a handle stud for a luggage case or the like.

19. A combination lock as set forth in claim 11, wherein the sleeve means and their associated dials are separable and have cooperable means for keying them together on the shaft, and wherein the lock further comprises resilient means normally urging the sleeve means into keyed relationship with their respective dials, and shifting means for moving the sleeve means out of keyed engagement from their respective dials.

* * * * *